US012714906B2

(12) United States Patent
Weller

(10) Patent No.: US 12,714,906 B2
(45) Date of Patent: Aug. 25, 2026

(54) METHOD AND APPARATUS FOR MEASURING ROWING SKILL

(71) Applicant: Keith Stanley Weller, Morden (GB)

(72) Inventor: Keith Stanley Weller, Morden (GB)

( * ) Notice: Subject to any disclaimer, the term of this patent is extended or adjusted under 35 U.S.C. 154(b) by 675 days.

(21) Appl. No.: 17/906,078

(22) PCT Filed: Mar. 10, 2021

(86) PCT No.: PCT/GB2021/000026

§ 371 (c)(1),
(2) Date: Sep. 12, 2022

(87) PCT Pub. No.: WO2021/181055

PCT Pub. Date: Sep. 16, 2021

(65) Prior Publication Data

US 2023/0115159 A1 Apr. 13, 2023

(30) Foreign Application Priority Data

Mar. 11, 2020 (GB) ..... 2003525

(51) Int. Cl.
*A63B 22/00* (2006.01)
*A63B 21/00* (2006.01)
(Continued)

(52) U.S. Cl.
CPC ..... *A63B 22/0076* (2013.01); *A63B 21/4031* (2015.10); *A63B 24/0006* (2013.01);
(Continued)

(58) Field of Classification Search
CPC ..... A63B 22/0076; A63B 21/4031; A63B 24/0006; A63B 2022/0079; A63B 2069/062; A63B 2220/58; A63B 2220/833
See application file for complete search history.

(56) References Cited

U.S. PATENT DOCUMENTS 5,072,929 A * 12/1991 Peterson ..... A63B 22/0012 310/105
8,608,626 B2 * 12/2013 Campbell ..... A63B 21/05 482/72

(Continued)

FOREIGN PATENT DOCUMENTS

WO WO-2012008664 A1 * 1/2012 ..... A63B 21/068
WO WO-2013006145 A1 * 1/2013 ..... G09B 19/0038

OTHER PUBLICATIONS

Gregory Smith, Oartec DX—First Impressions, Apr. 2, 2018, Rowing Analytics, pp. 1-11 (Year: 2018).*

(Continued)

*Primary Examiner* — Megan Anderson
*Assistant Examiner* — Jacqueline N L Loberiza
(74) *Attorney, Agent, or Firm* — RC Trademark Company

(57) ABSTRACT

The present disclosure relates to a system for providing real-time performance feedback on a rowing machine, the rowing machine comprising a load unit 1 coupled to a support track, a seat 5 slidably coupled to the support track for supporting a rower, a handle 3 coupled to the load unit arranged to move relative to the load unit by a pulling action on the handle, and a foot stretcher 4 coupled to the support track arranged to receive a pushing action thereon, the system comprising: a first sensor 13 configured to measure a first parameter indicative of the pulling action on the handle; a second sensor 11 configured to measure a second parameter indicative of the pushing action received by the foot stretcher; and a data processing unit, DPU, configured to determine a relationship between the pulling action on the handle and the pushing action received by the foot stretcher based on the first parameter and the second parameter.

9 Claims, 3 Drawing Sheets

(51) Int. Cl.
*A63B 24/00* (2006.01)
*A63B 69/06* (2006.01)

(52) U.S. Cl.
CPC . *A63B 2022/0079* (2013.01); *A63B 2069/062* (2013.01); *A63B 2220/58* (2013.01)

(56) References Cited

U.S. PATENT DOCUMENTS

| | | | | |
|---|---|---|---|---|
| 10,471,297 | B1 | 11/2019 | Smith et al. | |
| 2005/0085348 | A1 | 4/2005 | Kiefer et al. | |
| 2011/0118086 | A1* | 5/2011 | Radow ..... | A63B 21/00196 482/5 |

OTHER PUBLICATIONS

Concept2 Dynamic—Product Review, Feb. 12, 2017, Quantified Rowing, pp. 1-3 (Year: 2017).*

* cited by examiner

Figure 5
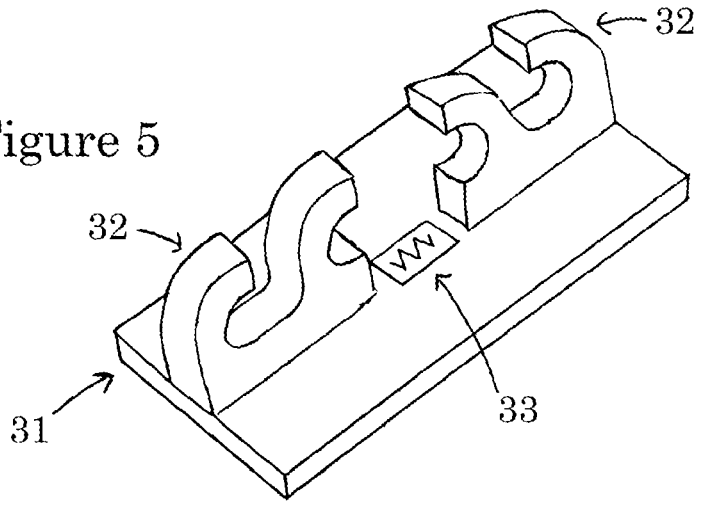
Figure 6
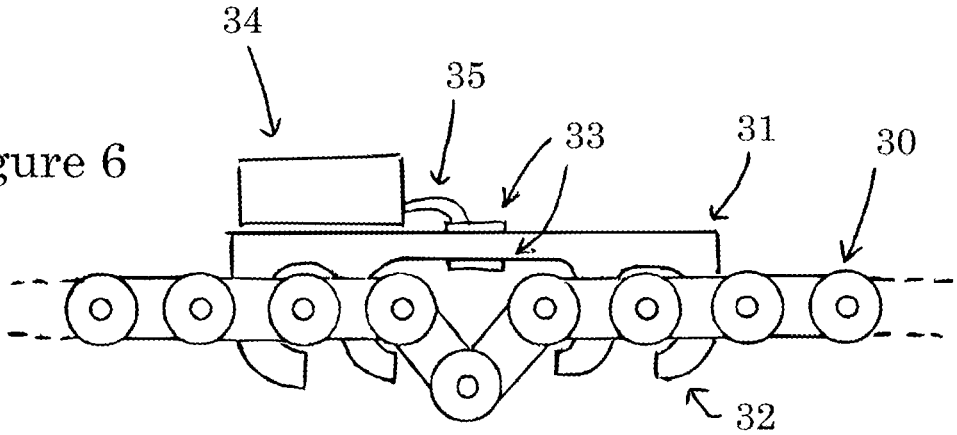
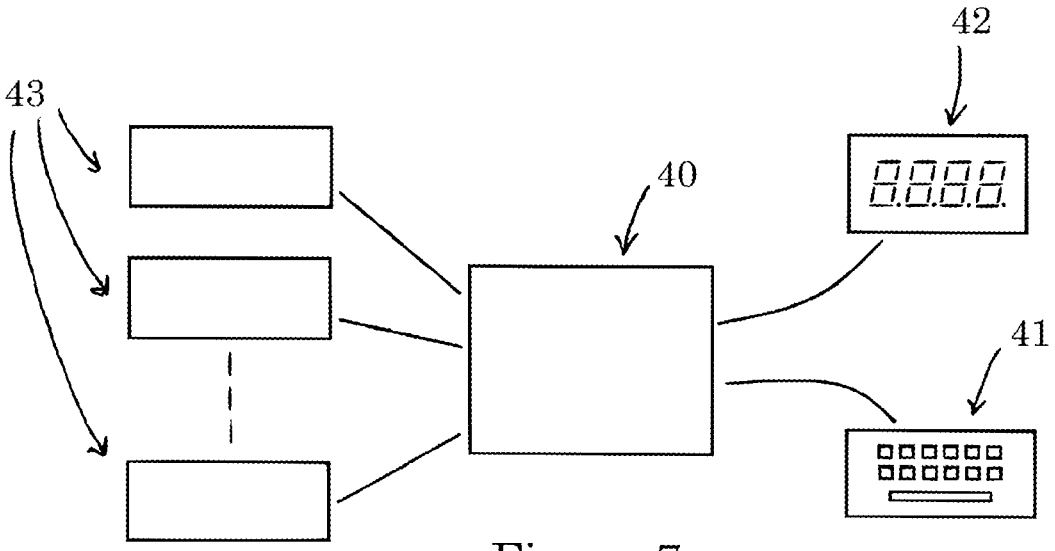
Figure 7

METHOD AND APPARATUS FOR MEASURING ROWING SKILL

CROSS-REFERENCE TO RELATED APPLICATIONS

This application is a National Phase Application of PCT International Application No. PCT/GB2021/000026, International Filing Date Mar. 10, 2021, claiming priority of GB Patent Application, 2003525.9, filed Mar. 11, 2020, and incorporated herein by reference in its entirety.

FIELD

The present disclosure relates to a method and associated apparatus to provide quantitative measurement of a rower's skill.

BACKGROUND

Glossary of terms used in the description:

'Load unit': The part of the rowing machine that dissipates the power generated by the rower 'Drive phase': the portion of the rowing stroke when the rower is applying force and velocity in the positive direction (i.e. away from the load unit) so that handle generates work in the load unit 'Recovery phase': the portion of the rowing stroke when the rower is moving the handle in the negative direction towards the load unit in preparation for the next drive phase, with negligible force on the handle 'The catch': the start of the drive phase 'The finish': the end of the drive phase 'Foot stretcher': the area where the rower's feet connect with the rowing machine or boat 'World frame': a fixed, inertial frame of reference for measuring the movements 'CM': Centre of mass 'ergo': A common abbreviation for the rowing machine, or rowing ergometer 'DPU': Data Processing Unit In the sport of competitive rowing much time is spent on developing not only the rower's strength and fitness, but also their skill in applying their available strength and fitness to moving the boat efficiently, to achieve the greatest possible speed over a target distance. Typically, a rower's skill is improved by a combination of learning from other more skilled rowers through observation and imitation, and by coaching, where a coach provides verbal qualitative feedback to the rower on how they may improve their movements to enhance their boat moving ability. This verbal form of feedback can be provided both on the land, using a rowing machine, and in an actual boat on the water. For team boats, the overall efficiency is also highly dependent on how well synchronised the individual rower's movements are with their team-mates.

A significant problem with the qualitative nature of verbal feedback is that the success in improving the rower's skill is strongly dependent on how accurately the coach can quantify and visually interpret the areas where a rower's movement efficiency may be improved, and then convert this subjective interpretation into a form of words that the rower can understand and apply to their body movements.

Frequently, the coach will support their analysis with video of the rower, but this is usually only practical after the rowing session has finished. The coach may also provide further verbal instruction after the session, but this delay in the feedback makes it much harder for the rower to assimilate the imparted information, since they are unlikely to be able to accurately relate what they are hearing and seeing post-hoc to their perception of their body movements (i.e. proprioception) during the session. The process is thus fraught with misunderstanding, and typically takes many sessions before significant improvement is achieved, if at all.

It is well known in the study of sports science that immediate (aka 'real-time') quantitative and impartial feedback allows the athlete to modify their movements by a process of experimentation, or 'trial and error', and will often result in a much more rapid improvement in their skill level, particularly when augmented by verbal coaching. This direct quantitative and objective feedback can ameliorate the mutual frustration that may arise between coach and athlete when verbal feedback alone isn't working well.

There is also frequently a psychologically detrimental effect due to 'fear of failure', or incurring the disapproval of the coach with subjective verbal feedback, and sometimes the tone of delivery used by the coach may exacerbate this problem.

Another hazard with subjective verbal coaching is that the coach may be tempted to try and correct more than one fault at a time in the coaching session, without having achieved tangible progress in any one fault; the rower may then feel overloaded with information during the session and become demotivated, feeling that they have too many faults, and are unable to make progress in rectifying them.

Rowing machines are frequently used as part of the training program for a rower. They typically measure the work done by the rower during the drive phase of the rowing stroke via a moveable handle coupled to a flywheel that provides resistance to the movement of the handle as the flywheel rotates, and thus attempts to replicate the resistance a rower experiences when moving the handle(s) of their oar(s) through the water in a real boat. The flywheel rotational resistance is frequently achieved with air braking vanes, but may also be achieved electrically via some form of electrical generator and load coupled to the flywheel. There are also variants that provide handle resistance via a linearly actuated element, such as a piston. In the following description, the term 'load unit' is used to encompass any such means of providing resistance to the handle movement.

A significant advantage of coaching the rower on a rowing machine is that it can be done in a controlled environment, hence not subject to the highly variable conditions typically experienced in an actual boat on the water. The machine also provides a quantitative measure of the rower's power output in real-time under controlled conditions, so is a good way to objectively and consistently compare fitness levels between rowers.

A significant problem with using the rowing machine as an indicator of a rower's ability however is that, typically, only the total power output that the rower delivers through the handle of the machine is measured, and not how efficiently this power might translate into moving an actual boat on the water. It is not uncommon for a rower to achieve good results in a rowing machine test, and yet not be able to replicate this performance in a real boat, due to one or more deficiencies in their rowing skill.

It is also common for a rower to adopt a particular style of movement that results in a good power measurement on a rowing machine, but which may actually prove detrimental to moving a real boat efficiently, and because a relatively large proportion of a rower's training is spent on the rowing machine compared to rowing in real boats, these poor stylistic habits may become ingrained by repetition.

The fact that traditional rowing machines simply measure the total power delivered through the handle of the machine by the rower also encourages the rower to consciously or subconsciously focus on utilising their arms to move the handle, whereas in reality, the larger part of their power output is generated by effectively utilising their legs and back during the drive phase, with the arms primarily used to couple that power to the handle for a significant proportion of the drive. Hence, encouraging the rower to focus on utilising the legs and back strongly in the movement will very often improve their performance in propelling an actual boat on the water.

SUMMARY

An aspect of the present technology provides a system for providing real-time performance feedback on a rowing machine, the rowing machine comprising a load unit coupled to a support track, a seat slidably coupled to the support track for supporting a rower, a handle coupled to the load unit arranged to move relative to the load unit by a pulling action on the handle, and a foot stretcher coupled to the support track arranged to receive a pushing action thereon, the system comprising: a first sensor configured to measure a first parameter indicative of the pulling action on the handle; a second sensor configured to measure a second parameter indicative of the pushing action received by the foot stretcher; and a data processing unit, DPU, configured to determine a relationship between the pulling action on the handle and the pushing action received by the foot stretcher based on the first parameter and the second parameter.

In some embodiments, the handle may be coupled to the load unit by means of a first chain or a first cable, and wherein the first sensor is coupled to the chain or the cable and configured to measure as the first parameter a tension applied to the first chain or the first cable when the handle is pulled to determine a pulling force.

In some embodiments, the support track may be mounted on a plurality of rollers arranged to run along a set of guide rails, wherein the second sensor may be coupled to at least one of the plurality of rollers and configured to measure as the second parameter a velocity of movement of the rowing machine relative to the floor, and wherein the DPU may be configured to derive a pushing force caused by the pushing action received by the foot stretcher using the velocity of [movement of] the rowing machine.

In some embodiments, the foot stretcher may be rigidly coupled to the load unit and the load unit is slidably coupled to the support track through a plurality of rollers, wherein the second sensor may be coupled to at least one of the plurality of rollers and configured to measure as the second parameter a velocity of movement of the load unit relative to the support track, and wherein the DPU may be configured to derive a pushing force caused by the pushing action received by the foot stretcher using the velocity of movement of the load unit.

In some embodiments, the foot stretcher may be slidably coupled to the support track through a plurality of rollers and coupled to the load unit by means of a second chain or a second cable, wherein the foot stretcher may be arranged to move relative to the load unit along the support track, wherein the second sensor may be coupled to at least one of the plurality of rollers and configured to measure as the second parameter a velocity of movement of the foot stretcher relative to the support track.

In some embodiments, the system may further comprise a third sensor coupled to the second chain or the second cable and configured to measure a tension applied to the second chain or the second cable when the foot stretcher is pushed, and wherein the DPU may be configured to determine the pushing action received by the foot stretcher as the tension applied to the second chain or the second cable.

In some embodiments, the load unit may comprise a flywheel, and the first chain or the first cable may be coupled to the flywheel by a cog or a pulley, and the system may further comprise a fourth sensor disposed at the cog or the pulley configured to measure a velocity of movement of the handle relative to the load unit.

In some embodiments, the system may further comprising a fifth sensor coupled to the seat configured to measure a velocity of movement of the seat relative to the support track, wherein the DPU may be configured to determine a relative velocity of the handle to the seat using the velocity of movement of the handle relative to the load unit and the velocity of movement of the seat relative to the support track.

In some embodiments, the DPU may be configured to determine the relationship as a ratio between the pulling action on the handle and the pushing action received by the foot stretcher based on the first parameter and the second parameter.

In some embodiments, the system may further comprise a communication connection configured to connect the DPU to one or more sensors disposed on one or more other rowing machines.

In some embodiments, the system may further comprise a communication connection configured to connect the DPU to a respective DPU disposed on another rowing machine.

In some embodiments, the rowing machine may be one of a plurality of rowing machines connected through a respective communication connection, and wherein the DPU is configured to determine a time profile of the relationship between the pulling action on the handle and the pushing action received by the foot stretcher.

In some embodiments, the rowing machine may be one of a plurality of rowing machines mechanically linked together.

In some embodiments, the system may further comprise a display, wherein the DPU is configured to perform the determination in real time and to display result of the determination in real time.

Another aspect of the present technology provides a computer-implemented method of providing real-time performance feedback on a rowing machine, the rowing machine comprising a load unit coupled to a support track, a seat slidably coupled to the support track for supporting a rower, a handle coupled to the load unit arranged to move relative to the load unit by a pulling action on the handle, and a foot stretcher coupled to the support track arranged to receive a pushing action thereon, the method comprising: measuring a first parameter indicative of the pulling action on the handle; measuring a second parameter indicative of the pushing action received by the foot stretcher; and determining in real time a relationship between the pulling action on the handle and the pushing action received by the foot stretcher based on the first parameter and the second parameter.

In some embodiments, the handle may be coupled to the load unit by means of a first chain or a first cable, and measuring the first parameter may comprise measuring a tension $T_h$ applied to the first chain or the first cable when the handle is pulled to determine a pulling force.

In some embodiments, the support track may be mounted on a plurality of rollers arranged to slide along a set of guide rails, and measuring the second parameter may comprise measuring a velocity $V_{ew}$ of movement of the rowing machine relative to the floor, the method may further comprise deriving a pushing force $F_f$ caused by the pushing action received by the foot stretcher using the velocity $V_{ew}$ of movement of the rowing machine according to the equation: $F_f=(T_h-M_e*dV_{ew}/dt)$, where $M_e*dV_{ew}/dt$ denotes a force acting on the rowing machine.

In some embodiments, the method may further comprise determining a power $P_{fw}$ of the pushing action delivered to the foot stretcher using the pushing force $F_f$ received by the foot stretcher and the velocity $V_{ew}$ of movement of the rowing machine according to the equation: $P_{fw}=-F_f*V_{ew}$.

In some embodiments, the method may further comprise: measuring a velocity $V_{hw}$ of movement of the handle relative to the load unit; and determining a power $P_{hw}$ of the pulling action delivered to the handle using the tension $T_h$ applied to the first chain or the first cable when the handle is pulled and the velocity $V_{hw}$ of movement of the handle according to an equation: $P_{hw}=T_h*V_{hw}$.

In some embodiments, the method may further comprise determining a centre of mass velocity $V_{rCMw}$ of the rower based on the mass of the rower $M_r$, the mass of the rowing machine $M_e$, and the velocity $V_{ew}$ of the movement of the rowing machine relative to the floor according to an equation: $V_{rCMw}=-(M_e/M_r)*V_{ew}$.

In some embodiments, the foot stretcher may be rigidly coupled to the load unit and the load unit is slidably coupled to the support track through a plurality of rollers, and measuring the second parameter may comprise measuring a velocity $V_{luw}$ of movement of the load unit relative to the support track, the method may further comprise deriving a pushing force $F_f$ caused by the pushing action received by the foot stretcher using the measured movement of the load unit.

In some embodiments, the method may further comprise determining a power $P_{fw}$ of the pushing action delivered to the foot stretcher using the pushing force Ff received by the foot stretcher and the velocity $V_{luw}$ of movement of the load unit according to the equation: $P_{fw}=-F_f*V_{luw}$.

In some embodiments, the foot stretcher may be slidably coupled to the support track through a plurality of rollers and coupled to the load unit by means of a second chain or a second cable, wherein the foot stretcher may be arranged to move relative to the load unit along the support track, wherein measuring the second parameter may comprise measuring a velocity of movement of the foot stretcher relative to the support track, $V_{fw}$.

In some embodiments, the method may further comprise measuring a tension $T_f$ applied to the second chain or the second cable when the foot stretcher is pushed, and determining the pushing action received by the foot stretcher as the tension applied to the second chain or the second cable.

In some embodiments, the method may further comprise measuring a power $P_{fw}$ of the pushing action delivered to the foot stretcher using the pushing force $T_f$ received by the foot stretcher and the velocity $V_{fw}$ of the foot stretcher according to the equation: $P_{fw}=-T_f*V_{fw}$.

In some embodiments, the method may further comprise: measuring a velocity $V_{sw}$ of movement of the seat relative to a world frame; determining a relative velocity $V_{h-s}$ of the handle to the seat using the velocity $V_{hw}$ of movement of the handle and the velocity $V_{sw}$ of movement of the seat according to an equation: $V_{h-s}=V_{hw}-V_{sw}$; and determining a numerical indicator as a real-time feedback of the rower's technique based on the relative velocity $V_{h-s}$.

In some embodiments, the method may further comprise comparing the numerical indicator with a reference corresponding to an optimum stroke profile.

In some embodiments, the method may further comprise: measuring a velocity of movement of the seat relative to the support track; determining a velocity of the rower's feet based on the velocity of movement of the rowing machine, the velocity of movement of the load unit, or the velocity of movement of the foot stretcher; and determining a relative velocity of the seat to the velocity of the rower's feet using the velocity of movement of the seat and the velocity of the rower's feet to provide an indicator of a rower's technique.

In some embodiments, the method may further comprise measuring a duration of time between when the seat is at a first position, wherein the first position may be a position along the support track when the seat is closest to the load unit and the time at which force is applied to the load through the handle or the foot stretcher.

In some embodiments, the rowing machine may be one or a plurality of rowing machines connected through a respective communication connection, and the method may further comprise determining a time profile of the relationship between the pulling action on the handle and the pushing action received by the foot stretcher.

In some embodiments, the method may further comprise determining a ratio between the pulling action on the handle and the pushing action received by the foot stretcher based on the first parameter and the second parameter.

A further aspect of the present technology provides a non-transitory computer-readable medium comprising machine-readable code, which, when executed by a processor, causes the processor to perform the method as described above.

A yet further aspect of the present technology provides a device for measuring a tension in a reciprocating chain, comprising: a coupling base configured to couple the device to the chain; one or more pawls disposed on the coupling base each configured to engage a link in the chain; and one or more flexural sensing elements mounted on the coupling base configured to generate an output signal indicating a flexure force imposed on the coupling base when the chain is under tension.

BRIEF DESCRIPTION OF THE DRAWINGS

Embodiments of the present technology will now be described with reference to the accompanying drawings, in which:

FIG. 5 shows the essential features of a sensor that can measure the tension in a chain connecting the handle to the load unit.

FIG. 6 shows the chain tension sensor of FIG. 5 installed on the handle chain of the rowing machine.

FIG. 7 shows a schematic representation of a data processing unit (DPU), a metric selection unit, and a display device, where the DPU is connected to the sensors from one or more rowing machines equipped with sensors according to an embodiment.

DETAILED DESCRIPTION

Figure 1:
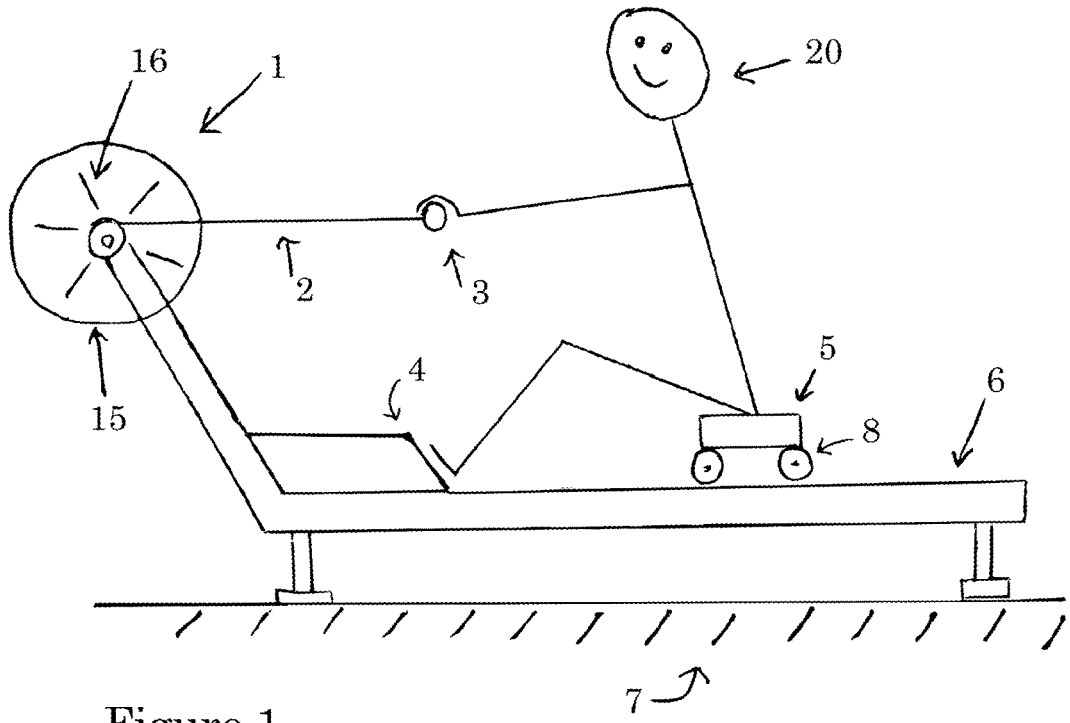
FIG. 1 shows a simplified schematic of the essential features of a typical rowing machine fixed to the floor, with the load unit in the form of a rotating flywheel with air braking vanes.

Some examples of specific rowing skill faults will now be outlined to illustrate the aspects of the rower's movement for which the present technology can provide real-time, quantitative feedback.

A fault colloquially referred to as 'shooting the slide' or 'bum shoving' is when the rower pushes against the load unit with their feet using their legs at the start of the drive phase without engaging their 'core' muscles to effectively couple the generated force through the handle to the load unit. This results in the seat of the rowing machine, and by implication the rower's centre of mass, moving faster than the handle at the beginning of the drive phase.

Another fault, in contrast to 'shooting the slide', is when the rower opens their body angle too forcefully at the catch using their back muscles, causing the handle to initially move faster than their centre of mass. This is sometimes referred to as 'lifting at the catch'.

To address the aforementioned problems and limitations, the present technology provides a method and associated apparatus to provide real-time quantitative feedback to the rower of selected metrics of particular aspects of their movement deemed important for rowing efficiency.

The feedback produced by the present technology is provided either during, or at the completion of each stroke, so that the rower may modify their movement patterns in real-time to endeavour to improve the reading of the chosen metric. The coach can facilitate this process by making verbal suggestions to the rower while they are actively rowing on the machine, and when the rower and coach find a form of movement that improves the metric, the immediacy of the feedback means that they can more readily retain the 'feel' of the improved movement in what is sometimes called their 'muscle memory'.

The coach or rower can select one particular metric to be displayed using the software provided with the apparatus, and then spend as much time as required to improve that metric before moving on to another metric, without the coach or rower being tempted to move on to correcting another fault before the first has been quantitatively improved.

The quantitative nature of the displayed metrics also allows the skill level of different rowers to be compared objectively, rather than subjectively by the coach. This removes any suggestion of bias by the coach in rower appraisal and team selection.

Also, the quantitative nature of the metrics allows the data to be easily recorded and referred back to assess how the rower is progressing over time from their participation in the training program.

The metrics may be derived in such a way that skill level is quantified and reported, not just gross power output, as currently presented by conventional rowing machines. This allows less powerful rowers to be identified as potentially faster rowers when competing in real boats against their more powerful counterparts, a feature that is especially helpful when selecting rowers for inclusion in team boats.

The present technology includes some form of electronic data processing unit, or DPU, that can simultaneously acquire data from one or more rowing machines fitted with the sensors described herein. This allows real-time feedback of selected metrics quantifying how well multiple rowers are synchronising their movements. The overall speed of a team boat is very dependent on this level of synchronisation, and providing simultaneous real-time feedback from more than one rower using the apparatus will allow a less skilled rower to modify their movements in real-time to endeavour to match the movements of a more skilled rower.

An 'optimum' stroke profile data set for a particular style of rowing may also be pre-programmed into the DPU so that all team members can endeavour to modify their movements in real-time towards this optimum during a training session. The optimum stroke profile can be acquired from an individual rower who the coach deems to most closely demonstrate the desired style of rowing, or alternatively, it may be derived from a mathematical model.

In FIG. 1, the load unit 1 of the rowing machine is comprised of a flywheel 15 with air braking vanes 16, and a chain or cable 2 connecting the handle 3 of the rowing machine to the flywheel of the load unit, typically via a cog or pulley. The rower 20 sits on a seat 5 that can freely move horizontally on rollers 8 along a seat support track 6 of the rowing machine. The rowing machine is fixed with respect to the world frame 7.

Figure 2:
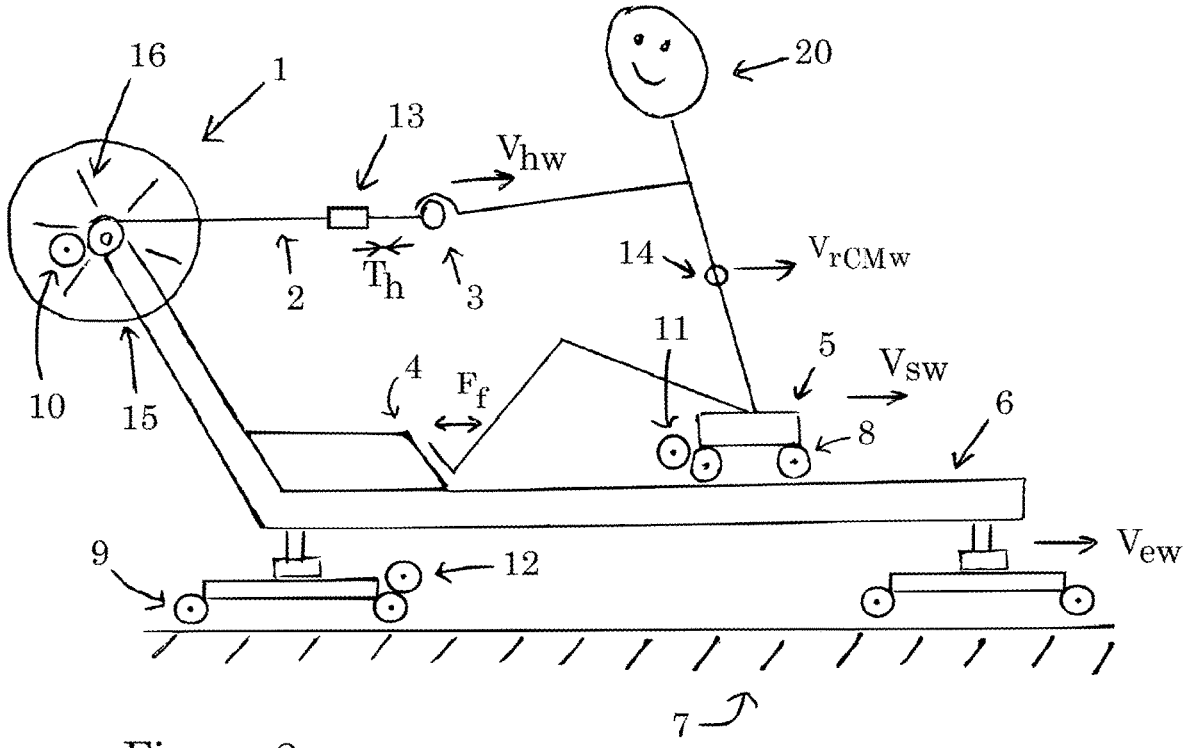
FIG. 2 shows the locations of the specified sensors attached to the typical rowing machine of FIG. 1, where the rowing machine is now mounted on an sliding base so that it may move relative to the floor, or 'world frame'. The principle velocities and forces referred to are also shown.

In FIG. 2, the rower and rowing machine of FIG. 1 is shown mounted on rollers 9, which are typically constrained to run on guide rails so that the rowing machine can freely move in one horizontal direction only relative to the world frame 7. A sensor 12, connected to any one of the rollers 9, measures the movement of the combined rowing machine and rower relative to the world frame 7. A second sensor 10 is linked to the cog or pulley coupling the handle chain or cable to the flywheel of the load unit, and measures the handle movement relative to the load unit. A third sensor 11 is linked to a roller of the sliding seat 8 to measure the movement of the seat relative to the seat support track 6. A force sensor 13 is fitted to the handle chain or cable to measure the tension therein.

The rower's centre of mass is shown located at 14 in FIG. 2, although it does move somewhat in relation to their body as their joint angles change during the stroke.

In FIG. 2, velocities measured relative to the world frame 7 are denoted with the subscript 'w', hence $V_{hw}$ is the handle velocity, $V_{ew}$ the velocity of the ergo, $V_{rCMw}$ the velocity of the rower's CM, and $V_{sw}$ the seat velocity, all measured in the world frame.

'$T_h$' is the tension measured by the handle chain or cable sensor. $F_f$ is the reaction force acting between the foot-stretcher and the rower's feet.

The measurement produced by sensor 12, $V_{12}$, is the velocity of the load unit and ergo relative to the world frame, i.e.:

$$V_{ew} = V_{12} \quad \text{(Equation 1)}$$

The velocity measured by sensor 10, $V_{10}$, is the velocity of the handle relative to the ergo, so expressed in world frame velocities:

$$V_{10} = V_{hw} - V_{ew} \quad \text{(Equation 2)}$$

Hence:

$$V_{hw} = V_{10} + V_{12}$$

Similarly, considering the measurement produced by sensor 11, $V_{11}$:

$$V_{11} = V_{sw} - V_{ew} \quad \text{(Equation 3)}$$

Hence:

$$V_{sw} = V_{11} + V_{12}$$

If the mass of the rower is $M_r$ and the mass of the ergo $M_e$, the CM of the entire system, i.e. rower and ergo, can be assumed to remain stationary in the world frame, since no external forces are acting on the entire system if one neglects the small frictional forces at the rollers, and air resistance.

Applying Newton's second law to the forces acting on the ergo, and neglecting the frictional force at the seat rollers 8:

$$M_e * dV_{ew}/dt = (T_h - F_f) \quad \text{(Equation 4)}$$

Rearranging:

$$F_f = (T_h - M_e * dV_{ew}/dt)$$

Similarly, considering just the horizontal components and applying conservation of momentum:

$$M_r * V_{rCMw} + M_e * V_{ew} = 0 \quad \text{(Equation 5)}$$

And rearranging:

$$V_{rCMw} = -(M_e/M_r) * V_{ew}$$

A metric that indicates how well the rower connects the force developed from their leg drive to the handle is given by the relative velocity of the handle to the seat, $V_{h-s}$, where:

$$V_{h-s} = V_{hw} - V_{sw} \quad \text{(Equation 6)}$$

If the rower tends to 'shoot the slide' as they start the drive phase then $V_{h-s}$ will be negative at that point, and the DPU can display a numerical indication of the magnitude of this 'slippage' through the early part of the drive phase. Alternatively, a range of levels could be pre-programmed into the DPU so it can present the feedback in other forms, for example red, amber and green lights or audible tones, or possibly a vibration generator in the seat or handle of the rowing machine to provide tactile feedback. One could also provide feedback via a harmless electrical stimulus to the skin.

Another useful metric than can be derived from the sensors is the relative proportion of power (or work, if the time integral of the power is computed) delivered by the rower to the ergometer via their legs at the foot-stretcher, $P_f$, and via the handle, $P_h$. Calculated in the world frame, these power values are:

$$P_{fw} = -F_f * V_{ew} \quad \text{(Equation 7)}$$

$$P_{hw} = T_h * V_{hw} \quad \text{(Equation 8)}$$

The DPU can measure the ratio $P_{hw}/P_{fw}$ through the drive phase and provide feedback of how well it matches an optimal stored profile measured against time or handle position, again using the various feedback methods previously mentioned.

It has been found experimentally that measuring the relative power ratio in the rower's CM frame gives a good indication of whether the rower is exhibiting the 'shooting the slide' or 'lifting' faults previously described.

$$P_{frCM} = -Ff * (V_{ew} - V_{rCMw}) \quad \text{(Equation 9)}$$

$$P_{hrCM} = Th * (V_{hw} - V_{rCMw}) \quad \text{(Equation 10)}$$

As before, the ratio $P_{frCM}/P_{hrCM}$ can be reported to the rower and coach in real-time by the DPU.

Another set of metrics that can readily be derived from the system are the absolute and relative amounts of impulse (i.e. change in momentum) delivered by the rower through the handle and foot-stretcher.

It has been found experimentally that there is some transfer of energy from the leg drive of the rower to the velocity of their CM in the world frame during the initial drive phase, and this 'stored' kinetic energy is then transferred to the load unit via the handle as the handle force and velocity are increased by the rower towards the middle and end of the drive phase. This effect can also be quantified in terms of momentum exchange.

The aforementioned exchange of energy and momentum between the velocity of the rower's mass and the machine is also understood to occur in a real boat, where the exchange speeds up the water velocity of the boat towards the end of the stroke as the rower's velocity relative to the water decreases. It is therefore advantageous to be able to quantify this in real-time so that the rower can improve how well they are able to employ the effect on the rowing machine, and then endeavour to replicate it in an actual boat using the proprioception they acquired on the machine.

Other metrics that can be readily obtained from the system are the time profile of the force, power and impulse developed at the handle, and also the corresponding profiles delivered through the foot-stretcher (see Equations 4, 7 and 9 for foot force and power derivations, for example).

It has been found experimentally in prior research that certain time profiles are indicative of an effective rowing style, so the DPU can be programmed with these exemplary profiles so that the rower can endeavour to match their stroke profile to the desired profile, again, using a real-time quantitative indication of the match quality. For this type of feedback some form of graphical display could advantageously be used, showing the rower's stroke profile overlaid against the desired profile.

It is also very useful to see in real-time how the chosen metrics degrade as the rower fatigues during a training session and/or as the rowing intensity increases, since that is an important feature of a skillful rower, namely their ability to maintain their skill throughout the entire duration of a race.

Where multiple systems are connected to a DPU as shown in FIG. 7, the DPU can provide real-time metrics for the quality and consistency of the time profiles between multiple rowers in a group training session. One such measure is how closely the rowers can time the start of their individual drive phases relative to each other; another is how closely in time they reach the peak of the forces generated at the handle and foot-stretcher respectively, and yet another is how closely in time they reach a certain percentage of the impulse they are delivering to the system through either the handle, foot-stretcher, or both.

To facilitate the aforementioned team coordination training, the rowing machines may be mechanically linked together so that each rower can feel the movement of the linked assembly. This does however mean that the foot force of each individual cannot be simply derived from the acceleration of the linked rowing machine assembly (i.e. by Equation 4), but other metrics can still be derived from the individual measurements of each rower's handle forces and velocities, and their seat and CM velocities.

Another advantageous feature, applicable to individual or multiple systems, is that the DPU can measure and continuously report in real-time the stroke length that each rower is achieving during over the duration of a session. Stroke length is the distance the handle travels with respect to the load unit, and, for a given size of rower it is a measure of their flexibility. It is understood in competitive rowing that maintaining consistent stroke length throughout a race is important, so having real-time feedback of stroke length during a training session on the rowing machine is very useful to enable the rower and coach to see if their stroke length is decreasing through fatigue, or as rowing intensity increases.

When multiple rowing machines are mechanically linked together one can measure whether the individuals are able to replicate the typical stroke length they can achieve when using the apparatus independently, since it is common for rowers to row to the shortest stroke length in a combined system, whether the system is in the form of linked rowing machines, or an actual team boat.

It is also useful to be able to monitor the total work a rower delivers to the load unit in each stroke, i.e. the integral of handle force and handle displacement over each completed stroke, and this metric can be calculated without reference to the foot forces, so is possible for mechanically linked rowing machines.

Yet another advantage of the system is that the peak force applied through the handle, or alternatively, the point in the stroke where the rower has achieve a certain percentage of their total handle impulse, can be precisely related to the handle position relative to the machine for either separate or linked rowing machines instrumented according to the present embodiment, and this information can be usefully employed to setup the rigging of a team boat so that each rower's output is optimally applied for their body size.

The system is also able to quantify how the rower moves on the rowing machine during the recovery phase of the stroke, for either separate or linked machines, and this information can also reveal certain skill deficiencies. One such is 'rushing the slide' where the rower approaches the catch position on the machine too quickly and in an uncontrolled fashion. The seat velocity relative to the machine, i.e. the seat velocity sensor output $V_{11}$, as well as the rower's CM velocity in the world frame $V_{rCMw}$ can be used to produce a feedback metric to quantify the degree of this fault.

The force on the foot-stretcher as the rower approaches the catch position may also be used to derive a metric of how well the rower is controlling their movement during the recovery phase on solitary rowing machine.

Another useful set of metrics that can be fed back in real-time relate to how the rower moves the handle during the recovery phase of the stroke. The speed of the handle relative to the rower, i.e. $(V_{hw}-V_{rCMW})$, may be measured and compared to an exemplary profile that the coach wishes the team to replicate. Typically a coach will provide verbal guidance from observation of how a rower moves their handle on the recovery relative to their team-mates, so the system can provide a more accurate, quantitative measure of this in real-time.

There is a rowing style sometimes adopted by highly skilled and well-coordinated rowers of intentionally accelerating the velocity of their CM towards the catch, which allows them to 'spring off' the foot-stretcher more explosively utilising the elasticity of their tendons and the neuromuscular 'stretch-reflex' response. This allows the rower to minimise the time they spend at the catch position before starting the drive phase, since this is typically where a real boat is slowed down the most.

The aforementioned technique can be practiced using appropriate feedback metrics calculated by the DPU, both individually and in team training sessions. The success of the technique depends on accurately applying handle force very soon after arriving at the catch position, so for example, a timing quality metric can be reported by the system to indicate the duration of time spent between arriving at the catch position and commencing the drive phase for an individual, and it can provide another metric indicating how well these periods overlap between two or more individuals being simultaneously monitored by the equipment.

Figure 3:
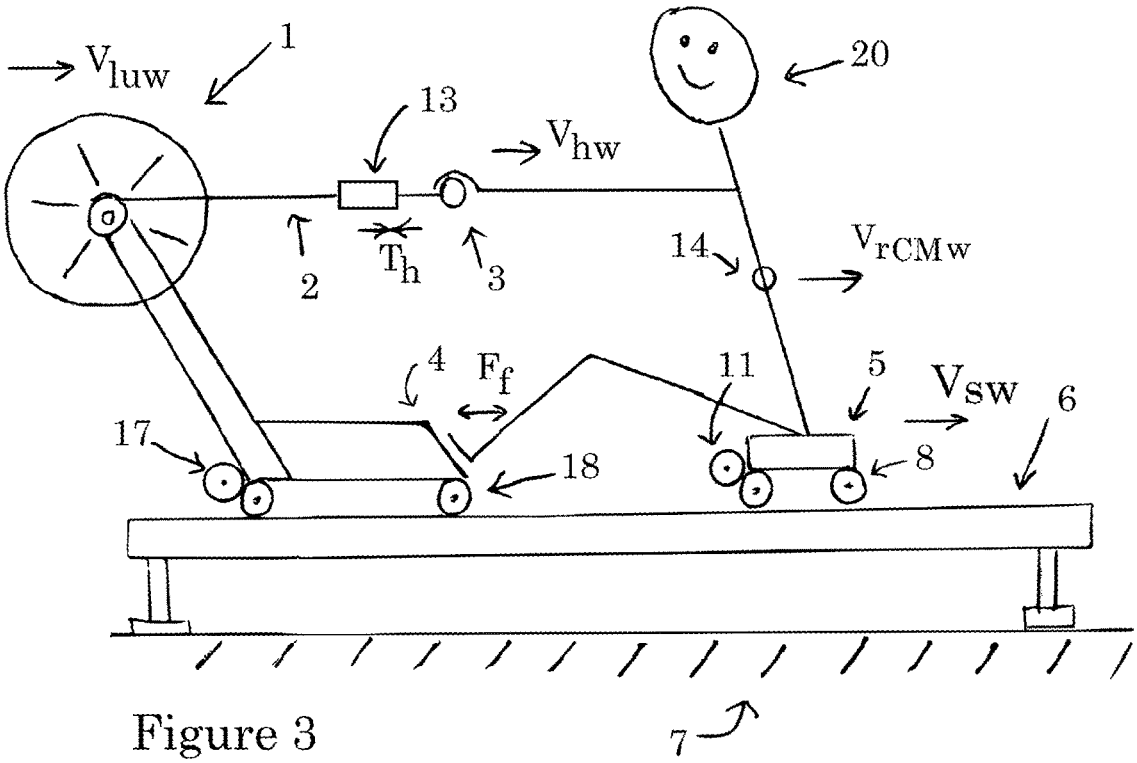
FIG. 3 shows the location of the specified sensors attached to a rowing machine with an integrated sliding load unit, showing the principle velocities and forces under consideration.

FIG. 3 shows the relevant sensors attached to a rowing machine with a sliding load unit 1 that can move horizontally on the support track 6 on rollers 18, along with the seat 5. A rotation sensor 17 is attached to one of the rollers 18 to measure the movement of the load unit relative to the support track, but as previously stated, this movement could be measured by means other than a rotational sensor in alternative embodiments.

It can be readily seen by a person having ordinary skill in the art that the parameters discussed previously can be derived from the sensors indicated on this type of the rowing machine; for instance, $M_e$ and $V_{ew}$ in Equation 5 are replaced by $M_{lu}$ and $V_{luw}$, the mass and velocity of the load unit, not the entire rowing machine.

Figure 4:
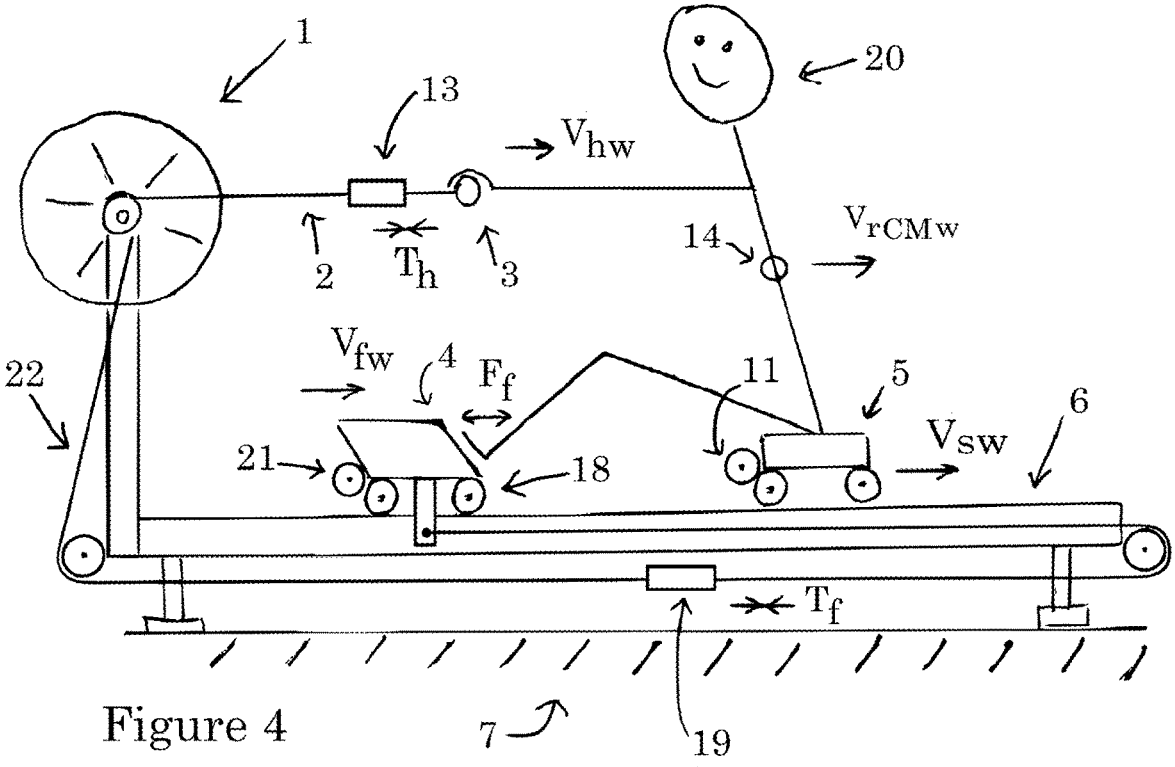
FIG. 4 shows the locations of the specified sensors attached to a rowing machine where the load unit is fixed in the world frame and the foot stretcher moves relative to the machine, again showing the principle forces and velocities.

FIG. 4 shows the relevant sensors attached to a rowing machine with a load unit 1 rigidly coupled to the support track 6, which in turn is fixed to the floor, i.e. the world frame 7. The foot-stretcher 4 can move horizontally on rollers 18 along the support track 6, along with the seat 5. Here, the rower's CM remains comparatively stationary relative to the world frame, and a mechanism allows both the handle and foot-stretcher to move independently to deliver power to the load unit. A seat movement sensor 11 measures the relatively small movement of the seat on the support track 6 so that the movement of the rower's CM can be accurately measured in the world frame. Sensor 21 measures the movement of the foot stretcher relative to the support track, and sensor 19 measures the tension, $T_f$, in the chain or cable 22 connecting the sliding foot-stretcher to the load unit.

In this embodiment, the foot force must be directly measured from the tension $T_f$, rather than being derived from Equation 4 for the rowing machines shown in FIGS. 2 and 3.

In the embodiments of the present technology described previously, the sensors to measure the velocities are rotary sensors, but in other embodiments the relative movements may be measured by non-rotary sensors, for example, magnetic or optical linear encoders, or ultrasonic or laser position sensors.

In other embodiments, the tension in the chain or cable coupling the handle to the load unit may be measured in the load unit itself, for example by measuring the angular acceleration of the flywheel, or with a force sensing load cell in the bearing support of the load unit flywheel, or in any of the guide wheels of the chain or cable. Similarly, the tension in the chain or cable coupling the moving foot-stretcher of the rowing machine of FIG. 4 to the load unit may be measured by such alternative means.

A significant advantage of the present technology is that the horizontal foot force $F_f$ is accurately determined without requiring force sensors to be placed between the rower's feet and the foot-stretcher. Such sensors already exist in the prior art, but it is difficult to measure the horizontal foot force component accurately without errors arising due to the direction and point of application of the force from the rower's feet to the sensor.

Errors may also be introduced by twisting the feet on the sensor, since the feet are typically strapped to the foot-stretcher and thus allow a torque to be applied to the intervening sensor. Such sensors are therefore often complex, bulky and expensive to manufacture if they are to provide good accuracy and reliability. A sensors is also normally required for each foot, further increasing cost and complexity.

FIG. 5 shows a perspective view of a chain tension sensor applicable to the present technology, and FIG. 6 shows how the roller chain 30, is attached to it by kinking the chain and hooking it on to the pawls 32 of the coupling member (or base) 31 so that the chain tension is transmitted through the coupling member. The coupling member would typically be fabricated from steel, and as tension is applied through the chain the member will flex approximately linearly in proportion to the amount of tension applied, as long as the tension doesn't approach the elastic limit of the material from which it is fabricated.

Preferably, a pair of flexural sensing elements 33 are mounted on opposite sides of the coupling member 31 to double the flexural signal generated when configured in an electrical bridge circuit, and also provide temperature compensation of thermal expansion of the substrate material, as is well known in the art. The flexural sensors would typically be strain gauges, although other devices, such as piezoelectric elements, may be used to produce an electrical signal proportional to the degree of flexure experienced by the coupling member.

An electronic circuit 34 connected to the flexural sensors via wires 35 amplifies their output signal and transmits it to the DPU, possibly via a flexible coiled cable attached to the rowing machine so that the handle may move freely, or alternatively by wireless means, such as radio, infrared or ultrasonic transmission. The amplified analogue signal from the flexural elements may be signal conditioned by the electronic circuit to improve linearity and correct for offsets, and may also be digitised before being transmitted to the DPU.

A significant advantage of the chain tension sensor shown is that it may be fitted and removed from a standard rowing machine chain easily, without requiring the handle to be removed or the chain to be split, such as would be necessary if a conventional load cell was employed. The chain tension sensor shown is more than accurate enough for the system requirements and simple to manufacture. Although the chain tension sensor has been described in the context of a rowing machine, it will be clear to a skilled person that the chain tension sensor can be used with any reciprocating chain.

FIG. 7 shows a schematic representation of the sensor connections from one or more rowing machines 43 to the DPU 40, an input device to select the metric to be fed back to the rower, 41, and the feedback output device 42. Some possible methods of feeding back the real-time information to the rower have previously been mentioned, including an alpha-numeric and/or graphical display, coloured lights, audible tones, or tactile devices such as vibration generators or electrical skin stimulus. Other options may be devised; the exact method used isn't an essential feature of the present technology.

Similarly, the metric selection device 41 isn't an essential feature of the present technology and may comprise buttons, keyboard, touch pad, or even voice recognition so the rower can change the feedback metric while still rowing.

A further advantage of the present technology is that the data required by the DPU to produce the chosen metrics may be obtained from a conventional rowing machine with minimal and relatively low cost additional apparatus. For example, an implementation of the sliding base depicted in FIG. 2 is already manufactured as an accessory for a commonly available rowing machine, and the additional rotational and chain force sensors identified herein can be manufactured at low cost and retrospectively added to an existing rowing machine and sliding base by a reasonably unskilled person.

What is claimed is:

1. A system for providing real-time performance feedback on a rowing machine, the rowing machine comprising a load unit (1) coupled to a support track (6), a seat (5) coupled to the support track configured to support a rower, a handle (3) coupled to the load unit arranged to move relative to the load unit by a pulling action on the handle, and a foot stretcher (4) coupled to the support track arranged to receive a pushing action thereon, the system comprising:

a first sensor configured to measure a first parameter indicative of the pulling action on the handle;

a second sensor (12; 17; 21) configured to measure a second parameter indicative of a velocity of movement of an element of the rowing machine caused by the pushing action received by the foot stretcher; and a data processing unit, DPU, configured to determine a relationship between the pulling action on the handle and the pushing action received by the foot stretcher based on the first parameter and the second parameter, wherein the foot stretcher (4) is rigidly coupled to the load unit (1) and the load unit is slidably coupled to the support track (6), wherein the element is the load unit and the second sensor (17) configured to measure as the second parameter a velocity of movement of the load unit relative to the support track.

2. The system of claim 1, wherein the handle is coupled to the load unit by means of a first chain or a first cable (2), and wherein the first sensor is coupled to the first chain or the first cable and configured to measure as the first parameter a tension applied to the first chain or the first cable when the handle is pulled to determine a pulling force.

3. The system of claim 1, wherein the load unit comprises a flywheel, wherein the first sensor is configured to measure the first parameter indicative of the pulling action on the handle by measuring an angular acceleration of the flywheel to derive a pulling force.

4. A computer-implemented method of providing real-time performance feedback on a rowing machine, the rowing machine comprising a load unit coupled to a support track, a seat coupled to the support track configured to support a rower, a handle coupled to the load unit arranged to move relative to the load unit by a pulling action on the handle, and a foot stretcher coupled to the support track arranged to receive a pushing action thereon, the method comprising:

measuring a first parameter indicative of the pulling action on the handle;

measuring a second parameter indicative of a velocity of movement of an element of the rowing machine caused by the pushing action received by the foot stretcher; and determining in real time a relationship between the pulling action on the handle and the pushing action received by the foot stretcher based on the first parameter and the second parameter, wherein the foot stretcher is rigidly coupled to the load unit and the load unit is slidably coupled to the support track, wherein the element is the load unit and measuring the second parameter comprises measuring a velocity Viuw of movement of the load unit relative to the support track.

5. The method of claim 4, wherein the handle is coupled to the load unit by means of a first chain or a first cable (2), and measuring the first parameter comprises measuring a tension applied to the first chain or the first cable when the handle is pulled, the method further comprising:

measuring a velocity $V_{hw}$ of movement of the handle relative to the load unit; and determining a power $P_{hw}$ of the pulling action delivered to the handle using the tension Th applied to the first chain or the first cable when the handle is pulled and the velocity $V_{dhw}$ of movement of the handle according to an equation:

$$P_{hw} = T_h * V_{hw}.$$

6. The method of claim 4, the method further comprising determining a power $P_{fw}$ of the pushing action delivered to the foot stretcher using the pushing force $F_f$ received by the foot stretcher and the velocity VIuw of movement of the load unit according to the equation:

$$P_{fw} = -F_f * V_{luw}.$$

7. The method of claim 4, further comprising determining a ratio between the pulling action on the handle and the pushing action received by the foot stretcher based on the first parameter and the second parameter.

8. A rowing machine comprising a load unit (1) coupled to a support track (6), a seat (5) coupled to the support track configured to support a rower, a handle (3) coupled to the load unit arranged to move relative to the load unit by a pulling action on the handle, a foot stretcher (4) coupled to the support track arranged to receive a pushing action thereon, and a system for providing real-time performance feedback on the rowing machine, wherein the system comprises:

a first sensor configured to measure a first parameter indicative of the pulling action on the handle;

a second sensor (12; 17; 21) configured to measure a second parameter indicative of a velocity of movement of an element of the rowing machine caused by the pushing action received by the foot stretcher; and a data processing unit, DPU, configured to determine a relationship between the pulling action on the handle and the pushing action received by the foot stretcher based on the first parameter and the second parameter, wherein the foot stretcher (4) is rigidly coupled to the load unit (1) and the load unit is slidably coupled to the support track (6), wherein the element is the load unit and the second sensor (17) configured to measure as the second parameter a velocity of movement of the load unit relative to the support track.

9. The method of claim 4, the method further comprising deriving a pushing force Ff caused by the pushing action received by the foot stretcher using the measured movement of the load unit.

* * * * *